US009277818B1

(12) United States Patent
Preston et al.

(10) Patent No.: US 9,277,818 B1
(45) Date of Patent: Mar. 8, 2016

(54) CORNER SHELF SYSTEM

(71) Applicants: Thomas J. Preston, Naperville, IL (US); Peter Masi, Mt. Prospect, IL (US)

(72) Inventors: Thomas J. Preston, Naperville, IL (US); Peter Masi, Mt. Prospect, IL (US)

( * ) Notice: Subject to any disclaimer, the term of this patent is extended or adjusted under 35 U.S.C. 154(b) by 0 days.

(21) Appl. No.: 14/691,182

(22) Filed: Apr. 20, 2015

(51) Int. Cl.
*A47B 23/00* (2006.01)
*A47B 96/02* (2006.01)
*A47B 96/06* (2006.01)

(52) U.S. Cl.
CPC ..... *A47B 96/022* (2013.01); *A47B 96/024* (2013.01); *A47B 96/066* (2013.01)

(58) Field of Classification Search
CPC .... A47B 96/022; A47B 96/024; A47B 96/06; A47B 96/061; A47B 96/066; F16M 13/02
USPC ..... 108/42, 152; 211/86.01, 90.01; 52/35.5, 52/35.6, 35; 312/408; 248/220.1, 250, 248/235, 231.9
See application file for complete search history.

(56) References Cited

U.S. PATENT DOCUMENTS 2,219,975 A * 10/1940 Bentz ..... 248/220.1
2,261,078 A * 10/1941 Shockey ..... 108/42
4,708,310 A 11/1987 Smith
5,513,575 A * 5/1996 Slade ..... 108/42
D395,186 S 6/1998 Pollack
6,301,725 B1 10/2001 Harvey
6,467,636 B1 10/2002 Schaefer
6,591,762 B1 * 7/2003 Haghayegh ..... 108/42
6,619,488 B2 * 9/2003 Bengoechea ..... 108/42
7,621,223 B2 11/2009 Haghayegh
7,987,535 B1 8/2011 Tesch
8,082,859 B2 * 12/2011 Sevack ..... 108/152
2006/0037133 A1 2/2006 Rizvi
2008/0224004 A1 * 9/2008 Gallien ..... 248/220.1
2014/0197119 A1 * 7/2014 Stenhouse ..... 211/26
2015/0182024 A1 * 7/2015 Nies ..... 108/42

* cited by examiner

*Primary Examiner* — Jose V Chen

(57) ABSTRACT

A corner shelf system for providing a shelf in a corner location. A first wall and a second wall are joined at a corner edge. A shelf base has a third biscuit slot located at a first side surface and a fourth biscuit slot located at a second side surface. An inner portion of a first biscuit and an inner portion of a second biscuit are partially housed in the third biscuit slot and the fourth biscuit slot, respectively. An outer portion of the first biscuit and an outer portion of the second biscuit have asymmetric edges. The outer portion of the first biscuit and the outer portion of the second biscuit are partially housed in a first biscuit slot of the first wall and a second biscuit slot of the second wall, respectively.

10 Claims, 6 Drawing Sheets

CORNER SHELF SYSTEM

FIELD OF THE INVENTION

The present invention relates to shelves for walls, in particular, shelves installed in wall corners.

BACKGROUND OF THE INVENTION

When installing a shelf in a corner location, such as a shower or bath stall, an installer would typically have to prop up the corner shelf while the corner shelf sets in place, as well as tile around the shelf edges. This process of installing a corner shelf is cumbersome and time-consuming. Moreover, the corner shelf may fall out of place while it is being propped-up. Hence, there is a need for a corner shelf that is more convenient for installing.

The system of the present invention provides an easy and fast means of installing a corner shelf, and an installer does not have to tile around the edges of the corner shelf once it is installed.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a corner shelf system for installing in a corner location, such as a shower or bath stall. In some embodiments, the corner shelf system comprises a corner location, a shelf base, a first biscuit, and a second biscuit. In some embodiments, the corner location comprises a wall corner edge, a first wall, and a second wall. The first wall and the second wall are joined at the wall corner edge. A first biscuit slot is disposed in the first wall perpendicular to the wall corner edge. A first biscuit slot posterior end of the first biscuit slot is about 1 unit away from the wall corner edge. A second biscuit slot is disposed in the second wall perpendicular to the wall corner edge. A second biscuit slot posterior end of the second biscuit slot is about 1 unit away from the wall corner edge.

In some embodiments, the shelf base has a first side surface and a second side surface joined at a base corner edge of the shelf base. The first side surface is placed against the first wall and the second side surface is placed against the second wall. The base corner edge is placed against the wall corner edge.

In some embodiments, a third biscuit slot is centrally disposed in the first side surface of the shelf base perpendicular to the base corner edge. A third biscuit slot posterior end of the third biscuit slot is about 1 unit away from the base corner edge. A fourth biscuit slot is centrally disposed in the second side surface of the shelf base perpendicular to the base corner edge. A fourth biscuit slot posterior end of the fourth biscuit slot is about 1 unit away from the base corner edge.

In some embodiments, the first biscuit comprises a first inner biscuit portion and a first outer biscuit portion fluidly connected between a first biscuit posterior end and a first biscuit anterior end. The first inner biscuit portion is housed in the third biscuit slot and the first outer biscuit portion extends outwardly from the third biscuit slot. In some embodiments, a first asymmetric outer edge of the first outer biscuit portion comprises a first recessed edge portion and a first anterior edge portion. The first recessed edge portion is proximal to the base corner edge. The first recessed edge portion and the first anterior edge portion are fluidly connected midway between the first biscuit posterior end and the first biscuit anterior end.

In some embodiments, the second biscuit comprises a second inner biscuit portion and a second outer biscuit portion fluidly connected between a second biscuit posterior end and a second biscuit anterior end. The second inner biscuit portion is housed in the fourth biscuit slot and the second outer biscuit portion extends outwardly from the fourth biscuit slot. In some embodiments, a second asymmetric outer edge of the second outer biscuit portion comprises a second recessed edge portion and a second anterior edge portion. The second recessed edge portion is proximal to the base corner edge. The second recessed edge portion and the second anterior edge portion are fluidly connected midway between the second biscuit posterior end and the second biscuit anterior end.

In some embodiments, the first outer biscuit portion is inserted into the first biscuit slot and the second outer biscuit portion is inserted in the second biscuit slot to mount the shelf base in the corner location. The first recessed edge portion and the second recessed edge portion prevent jamming of the shelf base when the shelf base is mounted in the corner location.

The present invention also features a method of installing a shelf in a corner location. In some embodiments, the method comprises providing a corner shelf system comprising a corner location, a shelf base, a first biscuit, and a second biscuit, making a biscuit cut into a first wall of the corner and making a second biscuit cut into a second wall of the corner; inserting the portion of the first biscuit that extends outwardly from the shelf base into the biscuit cut in the first wall, and inserting the portion of the second biscuit that extends outwardly from the shelf base into the biscuit cut in the second wall of the corner; and applying an adhesive to the corner system to secure the system in place.

DESCRIPTION OF PREFERRED EMBODIMENTS

Following is a list of elements corresponding to a particular element referred to herein:

100 corner shelf system
101 shelf
103 corner location
105 wall corner edge

Figure 1:
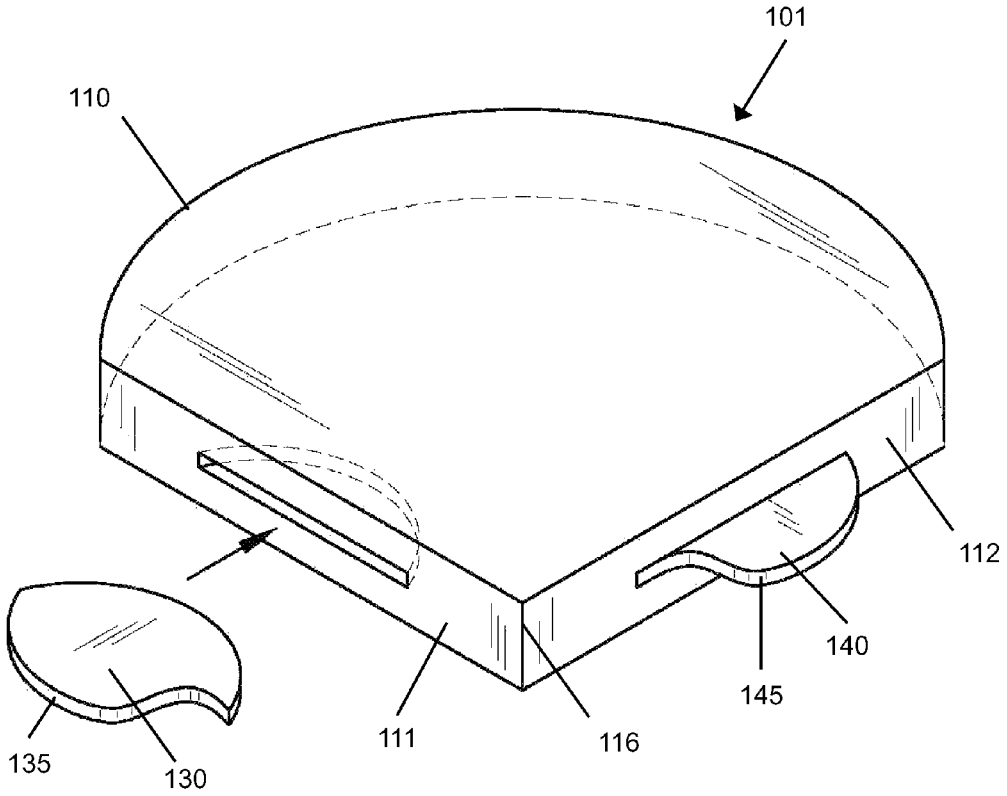
FIG. 1 shows a detailed view of the system of the present invention.
Figure 2A:
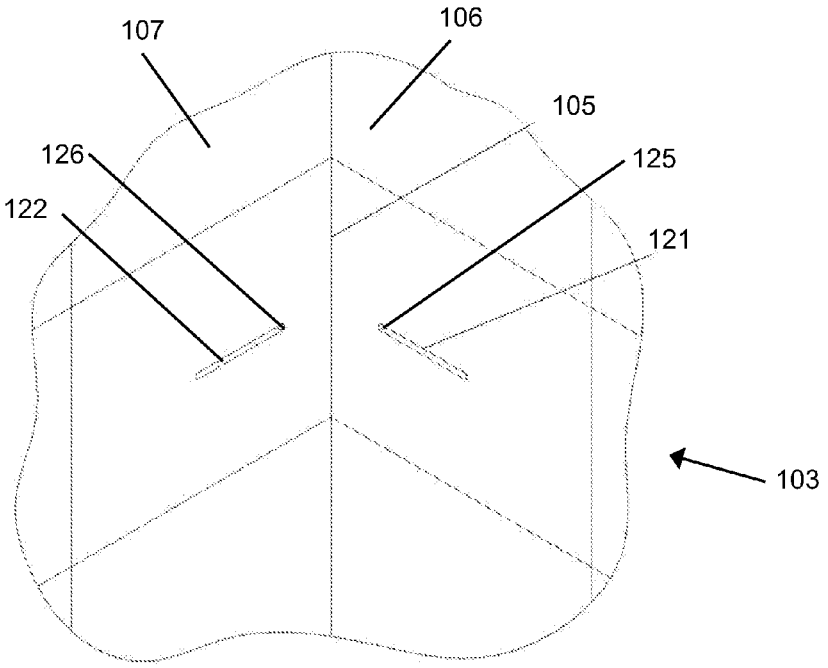
FIG. 2*a* shows a corner location of the present invention.
Figure 2B:
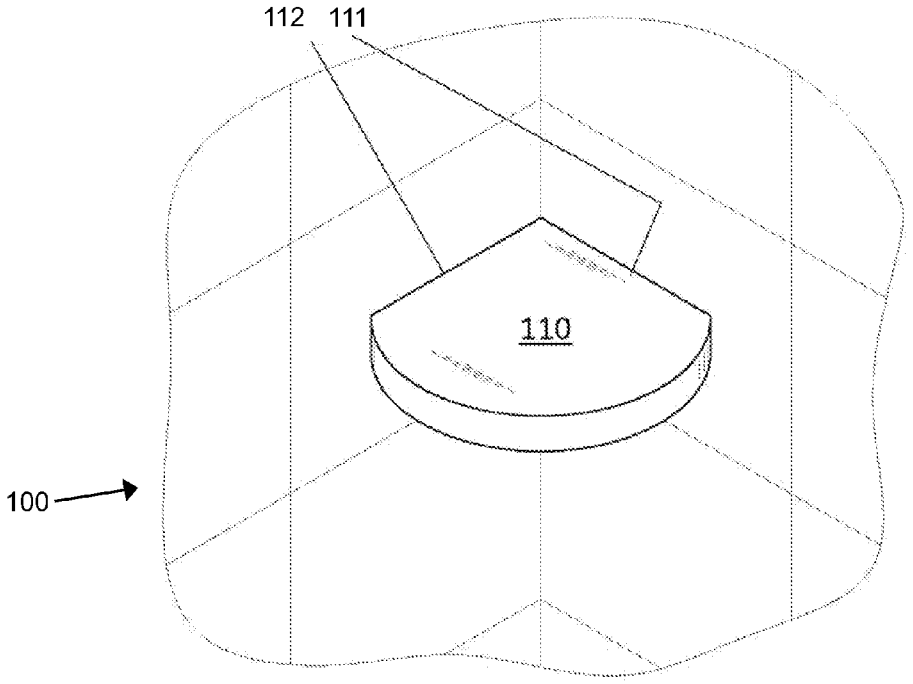
FIG. 2*b* shows an in-use view of the system of the present invention.
Figure 3:
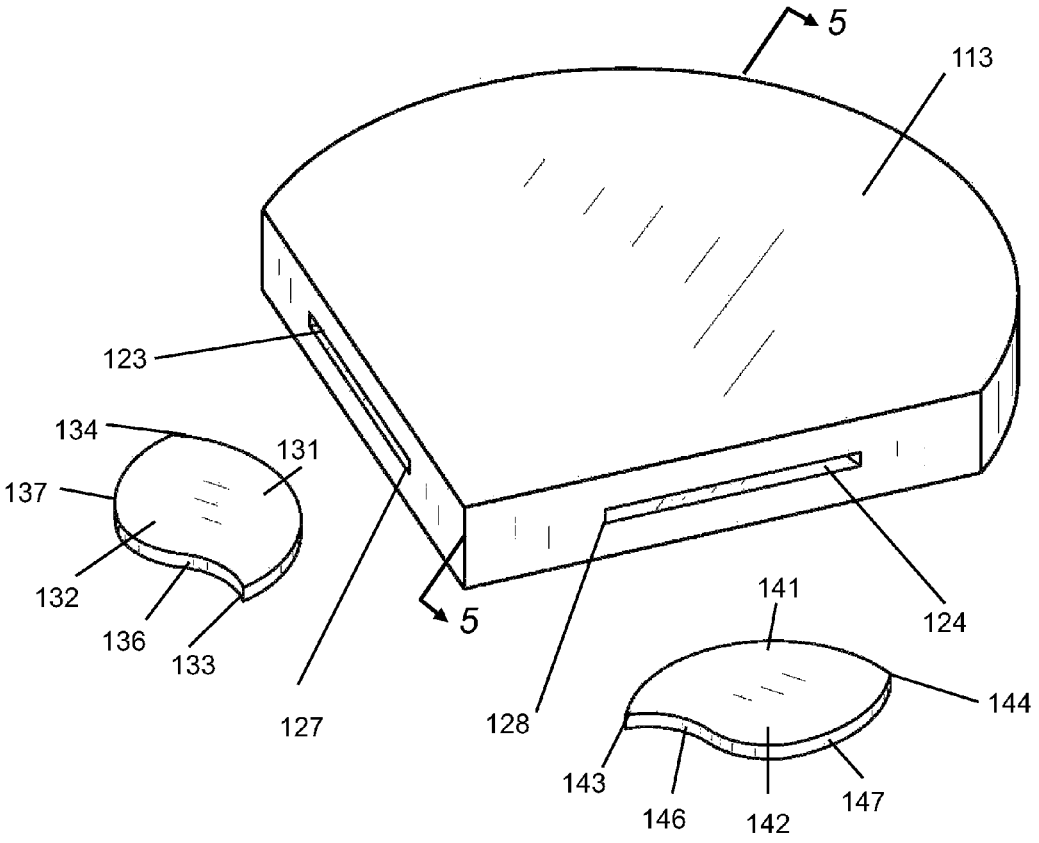
FIG. 3 shows a detailed perspective view of the system of the present invention.
Figure 4:
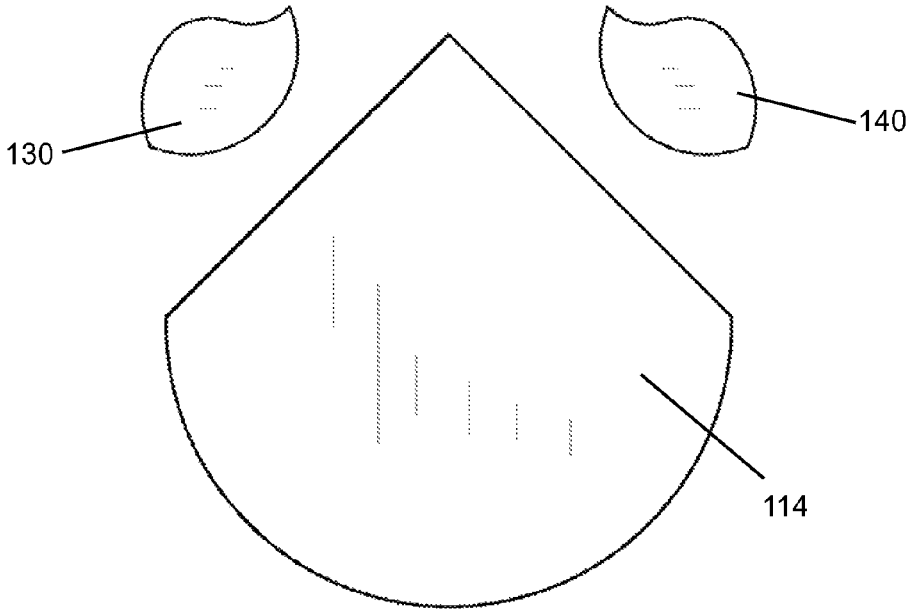
FIG. 4 shows a bottom view of the system of the present invention.
Figure 5:
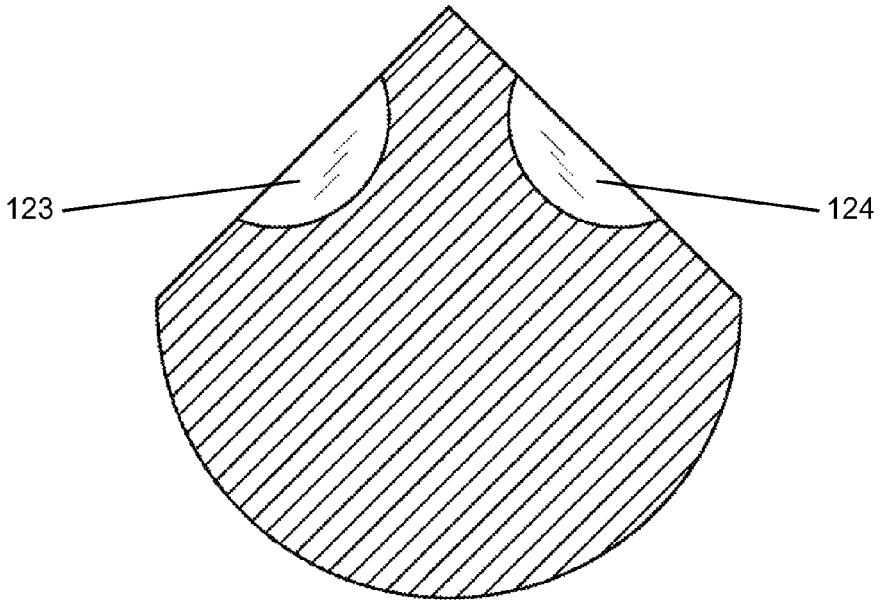
FIG. 5 shows a cross-sectional view of the system from FIG. 3.
Figure 6:
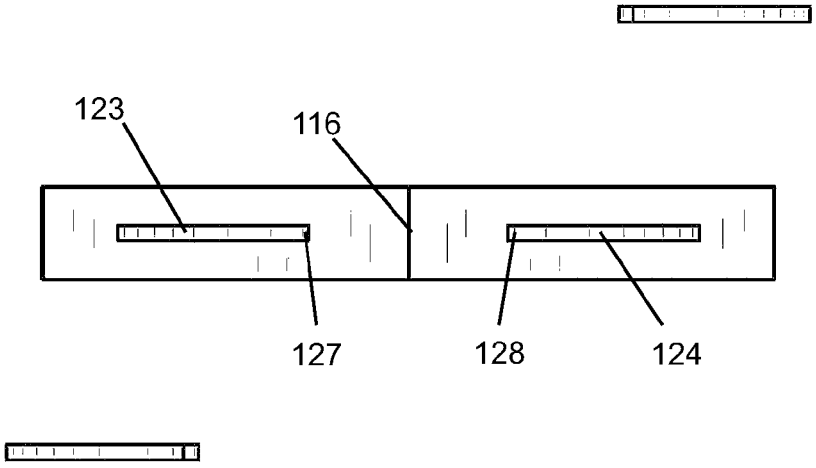
FIG. 6 shows a back view of the system of the present invention.
Figure 7:
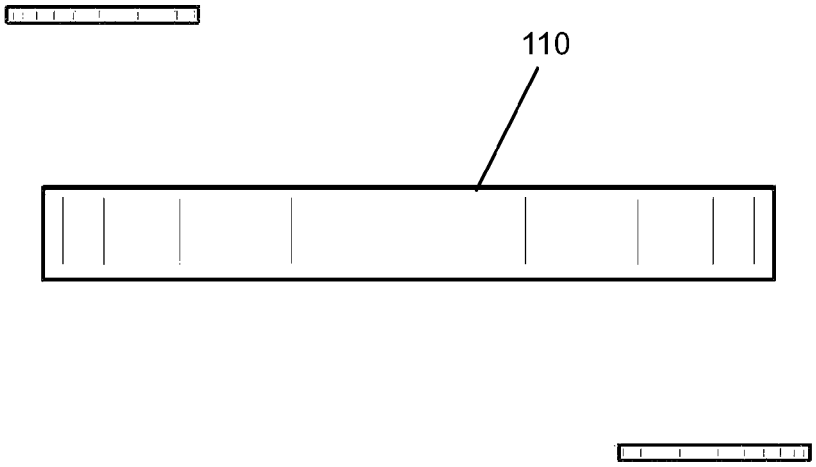
FIG. 7 shows a front view of the system of the present invention.
Figure 8A:
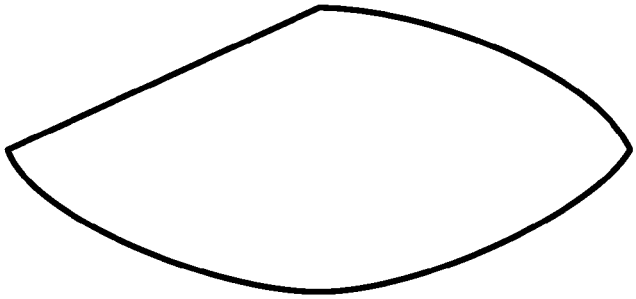
FIG. 8*a*-8*c* shows non-limiting alternative embodiments of biscuits of the present invention.
Figure 8B:
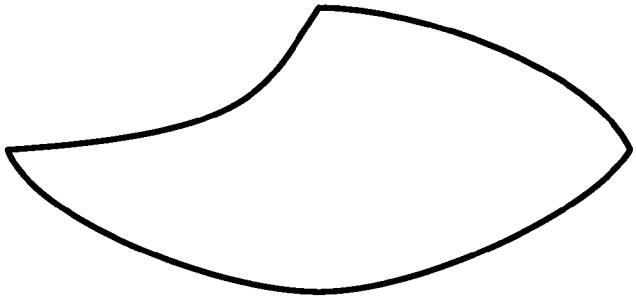
Figure 8C:
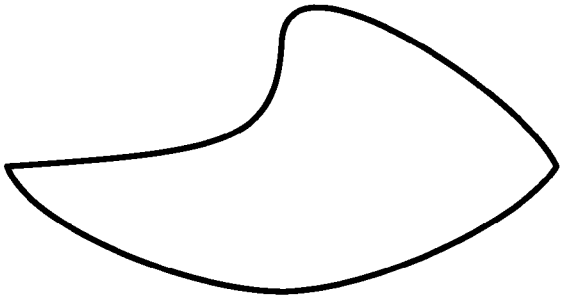

106 first wall
107 second wall
110 shelf base
111 first side surface
112 second side surface
113 top surface
114 bottom surface
116 base corner edge
121 first biscuit slot
122 second biscuit slot
123 third biscuit slot
124 fourth biscuit slot
125 first biscuit slot posterior end
126 second biscuit slot posterior end
127 third biscuit slot posterior end
128 fourth biscuit slot posterior end
130 first biscuit
131 first inner biscuit portion
132 first outer biscuit portion
133 first biscuit posterior end
134 first biscuit anterior end
135 first asymmetric outer edge
136 first recessed edge portion
137 first anterior edge portion
140 second biscuit
141 second inner biscuit portion
142 second outer biscuit portion
143 second biscuit posterior end
144 second biscuit anterior end
145 second asymmetric outer edge
146 second recessed edge portion
147 second anterior edge portion Referring now to FIGS. 1-8, the present invention features a corner shelf system (100) for providing a shelf (101) in a corner location (103). The system (100) comprises the corner location (103) comprising a wall corner edge (105), a first wall (106), and a second wall (107); a first biscuit slot (121) disposed in the first wall (106); a second biscuit slot (122) disposed in the second wall (107); a shelf base (110); a third biscuit slot (123) disposed in the shelf base (110); a fourth biscuit slot (124) disposed in the shelf base (110); a first biscuit (130); and a second biscuit (140).

In some embodiments, the first wall (106) and the second wall (107) are joined at the wall corner edge (105). In some embodiments, the first biscuit slot (121) is perpendicular to the wall corner edge (105). In some embodiments, the first biscuit slot (121) has a first biscuit slot posterior end (125) proximal to the wall corner edge (105). For example, the first biscuit slot posterior end (125) of the first biscuit slot (121) is about 1 unit away from the wall corner edge (105).

In some embodiments, the second biscuit slot (122) is perpendicular to the wall corner edge (105). In some embodiments, the second biscuit slot (122) has a second biscuit slot posterior end (126) proximal to the wall corner edge (105). For example, the second biscuit slot posterior end (126) of the second biscuit slot (122) is about 1 unit away from the wall corner edge (105).

In some embodiments, the shelf base (110) comprises a first side surface (111), a second side surface (112), a top surface (113), a bottom surface (114), and a base corner edge (116). In some embodiments, the first side surface (111) and second side surface (112) are joined at the base corner edge (116) of the shelf base (110). In some embodiments, the first side surface (111) may be placed against the first wall (106). The second side surface (112) may be placed against the second wall (107). In some embodiments, the base corner edge (116) is placed against the wall corner edge (105).

In some embodiments, the third biscuit slot (123) may be centrally disposed in the first side surface (111) of the shelf base (110). The third biscuit slot (123) may be perpendicular to the base corner edge (116). In some embodiments, the third biscuit slot (123) has a third biscuit slot posterior end (127) proximal to the base corner edge (116). For example, the third biscuit slot posterior end (127) of the third biscuit slot (123) is about 1 unit away from the base corner edge (116).

In some embodiments, the fourth biscuit slot (124) may be centrally disposed in the second side surface (112) of the shelf base (110). The fourth biscuit slot (124) may be perpendicular to the base corner edge (116). In some embodiments, the fourth biscuit slot (124) has a fourth biscuit slot posterior end (128) proximal to the base corner edge (116). For example, the fourth biscuit slot posterior end (128) of the fourth biscuit slot (124) is about 1 unit away from the base corner edge (116).

In some embodiments, a first biscuit (130) comprises a first inner biscuit portion (131), a first outer biscuit portion (132), a first biscuit posterior end (133) and a first biscuit anterior end (134). The first inner biscuit portion (131) and the first outer biscuit portion (132) may be fluidly connected between the first biscuit posterior end (133) and the first biscuit anterior end (134). In some embodiments, the first inner biscuit portion (131) is housed in the third biscuit slot (123). In some embodiments, the first outer biscuit portion (132) extends outwardly from the third biscuit slot (123), In some embodiments, a second biscuit (140) comprises a second inner biscuit portion (141), a second outer biscuit portion (142), a second biscuit posterior end (143) and a second biscuit anterior end (144). The second inner biscuit portion (141) and the second outer biscuit portion (142) may be fluidly connected between the second biscuit posterior end (143) and the second biscuit anterior end (144). In some embodiments, the second inner biscuit portion (141) is housed in the fourth biscuit slot (124). In some embodiments, the second outer biscuit portion (142) extends outwardly from the fourth biscuit slot (124).

In some embodiments, a first asymmetric outer edge (135) of the first outer biscuit portion (132) comprises a first recessed edge portion (136) and a first anterior edge portion (137). The first recessed edge portion (136) is proximal to the base corner edge (116). The first recessed edge portion (136) and the first anterior edge portion (137) may be fluidly connected midway between the first biscuit posterior end (133) and the first biscuit anterior end (134).

In some embodiments, a second asymmetric outer edge (145) of the second outer biscuit portion (142) comprises a second recessed edge portion (146) and a second anterior edge portion (147). The second recessed edge portion (146) is proximal to the base corner edge (116). The second recessed edge portion (146) and the second anterior edge portion (147) may be fluidly connected midway between the second biscuit posterior end (143) and the second biscuit anterior end (144).

In preferred embodiments, the first outer biscuit portion (132) is inserted into the first biscuit slot (122) and the second outer biscuit portion (142) is inserted in the second biscuit slot (122) to mount the shelf base (110) in the corner location (103). In preferred embodiments, the first recessed edge portion (136) and the second recessed edge portion (146) prevent jamming of the shelf base (110) when the shelf base (110) is mounted in the corner location (103).

In some embodiments, the first recessed edge portion (136) and the second recessed edge portion (146) are concaved. In other embodiments, the first recessed edge portion (136) and the second recessed edge portion (146) are sloping linear edges. In still other embodiments, the first recessed edge portion (136) and the second recessed edge portion (146) are S-shaped.

The purpose of the recessed edge of the biscuit is to allow for the outer portions of the biscuit to be inserted into the biscuit cuts of the walls without jamming of the outer portions. Conventional shaped biscuits usually have convexed edges, which would jam and prevent the shelf from being mounted because the shelf and biscuit assembly would be too wide for insertion into the corner location. The present invention would provide for a narrower shelf and biscuit assembly.

In some embodiments, the first anterior edge portion (137) and the second anterior edge portion (147) are convexed. In other embodiments, the first recessed edge portion (136) and the first anterior edge portion (137) form a general bell-shaped curve, and the second recessed edge portion (146) and the second anterior edge portion (147) form a general bell-shaped curve.

In some embodiments, the unit is about 1 inch, 1.5 inches, or 2 inches. In other embodiments, the unit is at least 1 inch, 1.5 inches, or 2 inches. In still other embodiments, the unit is between about 1 to 2.5 inches.

In some embodiments, the shelf base may be rectangular or triangular in shape. In other embodiments, the shelf base may be square in shape. In still other embodiments, the shelf base may be arc shaped. For example, the angle of the arc shape may be 90 degrees. In further embodiments, the shelf base may be in the shape of a quarter-circle. The shape of the shelf base is not limited to the aforementioned shapes, and may be of any desired shape for a corner wall.

In other embodiments, the shelf base may have a linear row of biscuit slots disposed in the first side surface or the second side surface. A distance between each biscuit slot may be 1 unit. The corner location would then have a linear row of biscuit slots disposed on the first wall or second wall. The distance between each biscuit slot may be 1 unit. For example, a row having at least two biscuit slots may be disposed in the first side surface or the second side surface. Therefore, a row having at least two biscuit slots may be disposed in the first wall or second wall. The number of biscuits slots of a row would depend on the size of the shelf that is being mounted. For example, a larger shelf may require at least two biscuit slots per row, or at least three biscuit slots per row, whereas a smaller shelf may require at least one biscuit per row.

In another embodiment, the present invention also features a method of installing a shelf system in a corner location. Any embodiment of the aforementioned corner shelf system may be used for installation. The method comprises providing the a shelf of the present invention. Next, a grinder is used to make biscuit cuts into the corner location where the shelf is to be installed, e.g., the shower wall. Then, the inner portions of the first and second biscuits are inserted into the first and second side surfaces of the shelf base, respectively. The first and second biscuits are inserted in the shelf base such that the recessed edges of the biscuits are proximal to the base corner edge. The outer portions of the biscuits that extend outwardly from the side surfaces of the shelf base can be inserted into the biscuit cuts in the wall. Finally, the biscuits can be sealed with an adhesives to secure the shelf base in place. Non-limiting examples of adhesives include epoxy or silicon.

As used herein, the term "about" refers to plus or minus 10% of the referenced number.

The disclosures of the following U.S. Patents are incorporated in their entirety by reference herein: U.S. Pat. No. 4,708,310; U.S. Pat. No. 6,301,725; U.S. Pat. No. 6,467,636; U.S. Pat. No. 7,621,223; U.S. Pat. No. 7,987,535; U.S. Pat. Application No. 2006/0037133; U.S. Design Pat. No. 395,186.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A corner shelf system (100) for providing a shelf (101) in a corner location (103), said system (100) comprises:

a. the corner location (103) comprising a wall corner edge (105), a first wall (106), and a second wall (107), wherein the first wall (106) and the second wall (107) are joined at the wall corner edge (105);

b. a first biscuit slot (121) disposed in the first wall (106), wherein the first biscuit slot (121) is perpendicular to the wall corner edge (105), wherein a first biscuit slot posterior end (125) of the first biscuit slot (121) is about 1 unit away from the wall corner edge (105);

c. a second biscuit slot (122) disposed in the second wall (107), wherein the second biscuit slot (122) is perpendicular to the wall corner edge (105), wherein a second biscuit slot posterior end (126) of the second biscuit slot (122) is about 1 unit away from the wall corner edge (105);

d. a shelf base (110) having a first side surface (111) and a second side surface (112), wherein the first side surface (111) and second side surface (112) are joined at a base corner edge (116) of the shelf base (110), wherein the first side surface (111) is placed against the first wall (106), wherein the second side surface (112) is placed against the second wall (107), and wherein the base corner edge (116) is placed against the wall corner edge (105);

e. a third biscuit slot (123) centrally disposed in the first side surface (111) of the shelf base (110), wherein the third biscuit slot (123) is perpendicular to the base corner edge (116), wherein a third biscuit slot posterior end (127) of the third biscuit slot (123) is about 1 unit away from the base corner edge (116);

f. a fourth biscuit slot (124) centrally disposed in the second side surface (112) of the shelf base (110), wherein the fourth biscuit slot (124) is perpendicular to the base corner edge (116), wherein a fourth biscuit slot posterior end (128) of the fourth biscuit slot (124) is about 1 unit away from the base corner edge (116);

g. a first biscuit (130) comprising a first inner biscuit portion (131) and a first outer biscuit portion (132), wherein the first inner biscuit portion (131) and the first outer biscuit portion (132) are opposite to each other and the first outer biscuit portion (132) is between a first biscuit posterior end (133) and a first biscuit anterior end (134), wherein the first inner biscuit portion (131) is housed in the third biscuit slot (123), wherein the first outer biscuit portion (132) extends outwardly from the third biscuit slot (123), wherein a first asymmetric outer edge (135) of the first outer biscuit portion (132) comprises a first recessed edge portion (136) and a first anterior edge portion (137), wherein the first recessed edge portion (136) is proximal to the base corner edge (116), wherein the first recessed edge portion (136) and the first anterior edge portion (137) are adjacent to each other and are midway between the first biscuit posterior end (133) and the first biscuit anterior end (134); and h. a second biscuit (140) comprising a second inner biscuit portion (141) and a second outer biscuit portion (142), wherein the second inner biscuit portion (141) and the second outer biscuit portion (142) are opposite to each other and the second outer biscuit portion (142) is between a second biscuit posterior end (143) and a second biscuit anterior end (144), wherein the second inner biscuit portion (141) is housed in the fourth biscuit slot (124), wherein the second outer biscuit portion (142) extends outwardly from the fourth biscuit slot (124), wherein a second asymmetric outer edge (145) of the second outer biscuit portion (142) comprises a second recessed edge portion (146) and a second anterior edge portion (147), wherein the second recessed edge portion (146) is proximal to the base corner edge (116), wherein the second recessed edge portion (146) and the second anterior edge portion (147) are adjacent to each other and are midway between the second biscuit posterior end (143) and the second biscuit anterior end (144); and wherein the first outer biscuit portion (132) is inserted into the first biscuit slot (122) and the second outer biscuit portion (142) is inserted in the second biscuit slot (122) to mount the shelf base (110) in the corner location (103); and wherein the first recessed edge portion (136) and the second recessed edge portion (146) prevent jamming of the shelf base (110) when the shelf base (110) is mounted in the corner location (103).

2. The corner shelf system (100) of claim 1, wherein the first recessed edge portion (136) and the second recessed edge portion (146) are concaved.

3. The corner shelf system (100) of claim 1, wherein the first recessed edge portion (136) and the second recessed edge portion (146) are sloping linear edges.

4. The corner shelf system (100) of claim 1, wherein the first recessed edge portion (136) and the second recessed edge portion (146) are S-shaped.

5. The corner shelf system (100) of claim 1, wherein the first anterior edge portion (137) and the second anterior edge portion (147) are convexed.

6. The corner shelf system (100) of claim 1, wherein the first recessed edge portion (136) and the first anterior edge portion (137) form a general bell-shaped curve, and the second recessed edge portion (146) and the second anterior edge portion (147) form a general bell-shaped curve.

7. The corner shelf system (100) of claim 1, wherein the unit is about 1 inch.

8. The corner shelf system (100) of claim 1, wherein the unit is at least 1 inch.

9. The corner shelf system (100) of claim 1, wherein the unit is between about 1 to 2.5 inches.

10. A corner shelf system (100) for providing a shelf (101) in a wall corner (103), said system (100) consists of:

a. the wall corner (103) consisting of a wall corner edge (105), a first wall (106), and a second wall (107), wherein the first wall (106) and the second wall (107) are joined at the wall corner edge (105);

b. a first biscuit slot (121) disposed in the first wall (106), wherein the first biscuit slot (121) is perpendicular to the wall corner edge (105), wherein a first biscuit slot posterior end (125) of the first biscuit slot (121) is about 1 unit away from the wall corner edge (105);

c. a second biscuit slot (122) disposed in the second wall (107), wherein the second biscuit slot (122) is perpendicular to the wall corner edge (105), wherein a second biscuit slot posterior end (126) of the second biscuit slot (122) is about 1 unit away from the wall corner edge (105);

d. a shelf base (110) consisting of a first side surface (111) and a second side surface (112), a top surface (113), and a bottom surface (114), and a base corner edge (116), wherein the first side surface (111) and second side surface (112) are joined at the base corner edge (116) of the shelf base (110), wherein the first side surface (111) is placed against the first wall (106), wherein the second side surface (112) is placed against the second wall (107), and wherein the base corner edge (116) is placed against the wall corner edge (105);

e. a third biscuit slot (123) centrally disposed in the first side surface (111) of the shelf base (110), wherein the third biscuit slot (123) is perpendicular to the base corner edge (116), wherein a third biscuit slot posterior end (127) of the third biscuit slot (123) is about 1 unit away from the base corner edge (116);

f. a fourth biscuit slot (124) centrally disposed in the second side surface (112) of the shelf base (110), wherein the fourth biscuit slot (124) is perpendicular to the base corner edge (116), wherein a fourth biscuit slot posterior end (128) of the fourth biscuit slot (124) is about 1 unit away from the base corner edge (116);

g. a first biscuit (130) consisting of a first inner biscuit portion (131) and a first outer biscuit portion (132), wherein the first inner biscuit portion (131) and the first outer biscuit portion (132)) are opposite to each other and the first outer biscuit portion (132) is between a first biscuit posterior end (133) and a first biscuit anterior end (134), wherein the first inner biscuit portion (131) is housed in the third biscuit slot (123), wherein the first outer biscuit portion (132) extends outwardly from the third biscuit slot (123), wherein a first asymmetric outer edge (135) of the first outer biscuit portion (132) consists of a first recessed edge portion (136) and a first anterior edge portion (137), wherein the first recessed edge portion (136) is proximal to the base corner edge (116), wherein the first recessed edge portion (136) and the first anterior edge portion (137) are adjacent to each other and are midway between the first biscuit posterior end (133) and the first biscuit anterior end (134); and h. a second biscuit (140) consisting of a second inner biscuit portion (141) and a second outer biscuit portion (142), wherein the second inner biscuit portion (141) and the second outer biscuit portion (142)) are opposite to each other and the second outer biscuit portion (142) is between a second biscuit posterior end (143) and a second biscuit anterior end (144), wherein the second inner biscuit portion (141) is housed in the fourth biscuit slot (124), wherein the second outer biscuit portion (142) extends outwardly from the fourth biscuit slot (124), wherein a second asymmetric outer edge (145) of the second outer biscuit portion (142) consists of a second recessed edge portion (146) and a second anterior edge portion (147), wherein the second recessed edge portion (146) is proximal to the base corner edge (116), wherein the second recessed edge portion (146) and the second anterior edge portion (147) are adjacent to each other and are midway between the second biscuit posterior end (143) and the second biscuit anterior end (144); and wherein the first outer biscuit portion (132) is inserted into the first biscuit slot (122) and the second outer biscuit portion (142) is inserted in the second biscuit slot (122) to mount the shelf base (110) in the wall corner (103); and wherein the first recessed edge portion (136) and the second recessed edge portion (146) prevent jamming of the shelf base (110) when the shelf base (110) is mounted to the wall corner (103).

* * * * *